US005809570A

United States Patent [19]

Grover

[11] Patent Number: 5,809,570

[45] **Date of Patent: *Sep. 22, 1998**

[54] WRIST HARNESS STRAP

[76] Inventor: Burton Leslie Grover, 804 S. 8th St., Fruitland, Id. 83619

[ * ] Notice: The term of this patent shall not extend beyond the expiration date of Pat. No. 5,634,213.

[21] Appl. No.: 784,910

[22] Filed: Jan. 16, 1997

Related U.S. Application Data

[63] Continuation of Ser. No. 659,889, Jun. 6, 1996, Pat. No. 5,634,213.

[51] Int. Cl.[6] ..... A41D 19/00

[52] U.S. Cl. ..... 2/161.1; 2/162; 441/69

[58] Field of Search ..... 2/159, 161.1, 161.6, 2/161.8, 162, 170; 482/44, 49; 441/68, 69; 294/25

[56] References Cited

U.S. PATENT DOCUMENTS

| | | | |
|---|---|---|---|
| 3,262,126 | 7/1966 | Price | 2/159 |
| 3,381,304 | 5/1968 | Coco | 2/20 |
| 4,235,182 | 11/1980 | Bürger | 440/34 |
| 4,400,831 | 8/1983 | Rietz | 2/161.1 |
| 4,487,412 | 12/1984 | Meeko | 272/123 |
| 4,720,279 | 1/1988 | Fritschen et al. | 2/161.1 |
| 4,730,354 | 3/1988 | Saito | 2/161 |
| 4,793,005 | 12/1988 | Hetzel, Jr. | 2/161.1 |
| 4,923,418 | 5/1990 | Hoffman | 441/57 |
| 5,004,231 | 4/1991 | Alread | 2/161.1 |
| 5,022,094 | 6/1991 | Hames et al. | 2/161 |
| 5,033,119 | 7/1991 | Wiggins | 2/161 |
| 5,197,149 | 3/1993 | Overton | 2/161 |
| 5,324,244 | 6/1994 | Miller et al. | 462/106 |
| 5,350,343 | 9/1994 | DaSilva | 482/106 |
| 5,353,440 | 10/1994 | Meldeau | 2/161.1 |
| 5,459,883 | 10/1995 | Garceau-Verbeck | 2/161.1 |
| 5,553,324 | 9/1996 | Emerson | 2/161.1 |
| 5,557,805 | 9/1996 | Emerson | 2/158 |
| 5,557,806 | 9/1996 | Caswell et al. | 2/161.1 |

*Primary Examiner*—Michael A. Neas
*Attorney, Agent, or Firm*—Ken J. Pedersen; Barbara S. Pedersen

[57] ABSTRACT

Apparatus for augmenting the grip of a user when gripping an object subjected to a pulling force including an elongated flat rolling strap with a friction or gripping section adapted to be positioned along the palm of the user and having a novel wrist cinching strap system operative to transmit the pulling force on the object through the user's forearms to the upper arms and shoulders of the use.

6 Claims, 7 Drawing Sheets

WRIST HARNESS STRAP

This is a continuation of Ser. No. 08/659,889 filed Jun. 6, 1996, now U.S. Pat. No. 5,634,213.

FIELD OF THE INVENTION

This invention relates to an arrangement for enhancing a user's grip and, more particularly, apparatus for augmenting the grip of a user on such objects as, but not limited to, a water ski tow bar, which apparatus couples the force required for gripping into the arm and shoulder muscles aiding in relieving strain on the user's hands and forearms.

BACKGROUND OF THE INVENTION

In the prior art, various methods have been devised to enhance the gripping of an object, particularly towbars used in various sports. More particularly, such gripping methods have been devised for use in water sports such as of water skiing which involves a suitable tow rope with a crossbar type handle which the skier utilizes by grasping it with his hands to be pulled by the boat or in the more recent sport of wind surfing.

A common problem to water skiers, regardless to their experience, is the muscle fatigue experienced in the hands and forearm caused by the pulling forces exerted by the tow bar being transmitted through the hands and arms to the fingers and hands with the muscles of the hands and forearms being highly stressed under the pulling action involved. Further, the skier needs to tightly hang onto the towbar to prevent inadvertent release of the towbar, causing stress on the skier's hands which can be excessively fatiguing and can give rise to loss of the handle, terminating the skier's run which, depending on the circumstances, may be dangerous.

Additionally, those who ski regularly have developed callouses on their hands, caused by the glove pinching at the joint of the finger, with the problem often times so acute that taping of the hands is practiced to minimize the problem.

One particular prior art device is described in U.S. Pat. No. 4,400,831 issued to Rietz. Rietz '831 is directed to a water ski glove having a palm side strapping that extends across the glove palm portion and along and between the glove-wrist portion on the palm side of the glove and the glove fingers again on the palm side. A protuberant rectilinear rib is affixed to the strapping and extends cross-ways on the strapping just below the first joint of the index finger. Also anchored to the glove's palm side strapping adjacent the wrist portion of the glove is a thrust transmitting wrist strap which has one end anchored to the glove wrist portion adjacent to the palm side such that the wrist strap may be firmly wrapped around the glove wrist portion when on the user's hand and affixed with a self-gripping or adhering fabric such as Velcro® to securely anchor the wrist strap in place. As a result, bar placement is limited to the socketing of the rib against the bar when the rib is positioned during tow-bar placement thereby providing limited flexibility in use and during release.

The skier grasps the tow rope handle in the usual manner positioning the bar in friction fit between his fingers and the tow bar. By continuing to maintain his hold, the pulling action of the tow rope applied to the towbar is transmitted to the glove through the palm side rib, palm strapping and wrist strap of the skier's gloves to his wrist and arm skeletal structure relieving tension on the muscles of the hands and forearms. Release of the indicated purchase is affected by the water skier merely straightening out his fingers to release the friction hold of the rib with the towbar.

However, the use of such a device is extremely sensitive to the amount of pressure applied such that too little pressure would cause the rod to disengage from the towbar, causing a "handle snap" where the towbar is suddenly and forcefully snatched from the skier's grasp and ending the run sometime at an awkward moment. Even in a planned release, the rib engagement has a "hang" time, i.e., a momentary pause before actual release, which may cause an upset.

In an attempt to overcome the inadvertent release problem, Rietz '831, provides for a towbar in which a groove has been formed with the groove positioned to receive the rib when the towbar is grasped to prevent such slippage. Unfortunately, during a planned release this combination results in and even longer "hang" time. Additionally, as the rib-groove placement is rigidly fixed, tow-bar placement is lacking in flexibility.

The problem's inherent in the above-described apparatus is that the amount of pressure required to maintain the skier's grip on the towbar. In certain situations, it becomes necessary for the skier to immediately disengage from the towbar in order to prevent injury or other damage. In anticipating release, the skier may inadvertently ease the pressure on the crossbar to a degree that a "handle snap" occurs, again terminating the run. Alternatively, the skier may exert too much pressure in which case his control of handle release is not as accurate or as timely as he desires.

When the grooved handle is utilized, the time for disengagement with the tow-bar handle by the skier is increased which can result in, emergency situations, danger to the skier, loss of control, balance, and the like. This problem also carries over to the planned release of the handle as above described.

SUMMARY OF THE INVENTION

In accordance with the present invention, apparatus is provided for use in securing a grip around any roundish-like object, such as a water-skiing tow-bar or a wind-surfing boom, which the user can wrap his fingers around. The gripping device is an elongated, flat, sliding, strap loop with a friction or gripping section having an anchor at one end in the form of a novel wrist cinching strap system. The front of the friction or gripping pad continues in a loop which lays back over the gripping pad and extends to the underside of the wrist and attaches to a plastic sleeve, made of such material as neoprene, which snugly fits around the user's wrist to keep the top strap properly located above the grip strap. In one embodiment, a finger loop is attached to the top strap and consists of a simple loop having a wider reinforced inside, flat, top section, which, when the sides are pressed together, forms a T-like or flanged anchor brace. Thus the loop can be used in several ways and provides multiple positioning of the device whereby inserting a finger within the loop or by closing two fingers on either side of the "T" to form a grip which anchors the fingers to the top of the strap for frontal control of the apparatus.

In use, as a user grips a circular-like object, the friction or gripping surface clings to it because of the progressive pressure applied by the finger tips progressing along the length of he fingers to the palm of the user's hand. The top strap slides over the stationary grip pad strap until the hand wrist area comes in contact with the wrist cinch strap system, locking or securing a confident grip. The effort of the forearm is transferred to the back of the hand and to the skeletal structure of the upper arm and shoulder area. Thus grip time is greatly enhanced, forearm fatigue is relieved and, releaseability is instantaneously available. Further, release is smooth unlike other prior art devices which utilize a dowel which can snag while the user attempts to disengage his grip or which may inadvertently release during use. Further, the user's grip may be instantaneously regained, unlike the prior art device which once loosened from its socket is hard to regain.

Accordingly, it is an object of the invention to provide a device whereby the user can establish a hand grip on a tow-bar, boom or handle a structural purchase and a force transmitting connection to the base of his wrist area that permits the pulling thrust on the handle to be transferred and applied to the skeletal structure of the user's arms by way of the user's wrists whereby muscle fatigue in the user's hands and forearms is avoided, and enhancement of the user's long term grip results.

It is another object of the invention to provide flexibility of the apparatus to permit the user to position his fingers or the palm of his hand relative to the handle or tow-bar as desired, so as to establish a firm stress-avoiding structural purchase between himself and the handle which is effectively and simply maintained irrespective of the force pulling on the handle or boom.

It is still another object of the invention to provide apparatus for the user to effectively couple himself to a bar in a manner which avoids the callusing problem, resulting from such things as glove pinching suffered by suffered by the users, by establishing a structural purchase between the towbar and the structural skeleton of the skier.

It is yet another object to provide apparatus to the user that is readily available and positioned for use as desired or needed and is releasable upon the same basis as the user properly positioning his fingers relative to the towbar or boom.

Further features and advantages of the invention will be apparent to those skilled in the art from the following detailed description, taken together with the accompanying drawings.

DETAILED DESCRIPTION OF THE PREFERRED EMBODIMENTS

Figure 1:
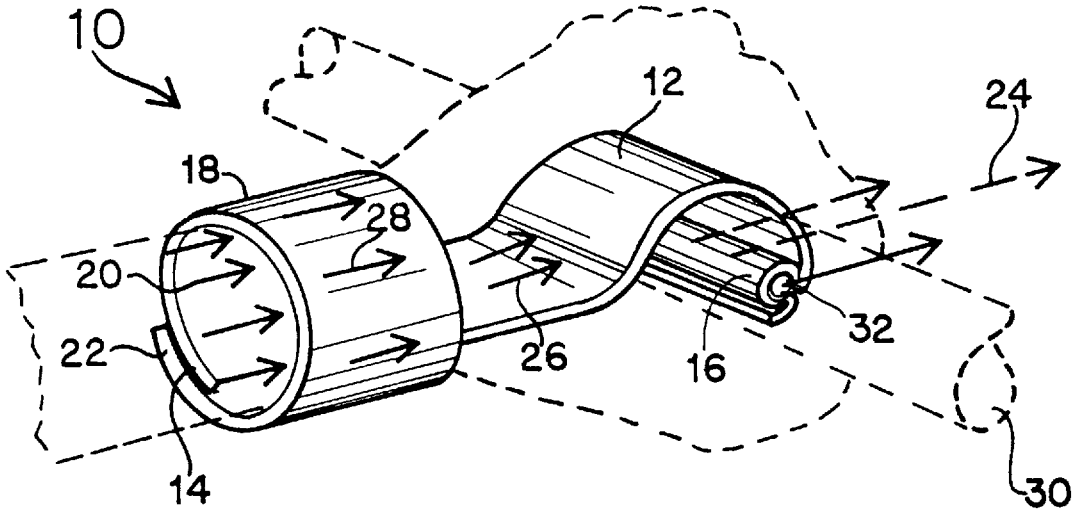
PRIOR ART FIG. 1
FIG. 1 is a perspective view of a prior art device illustrating the use of a dowel or rod to increase grip purchase.
Figure 2:
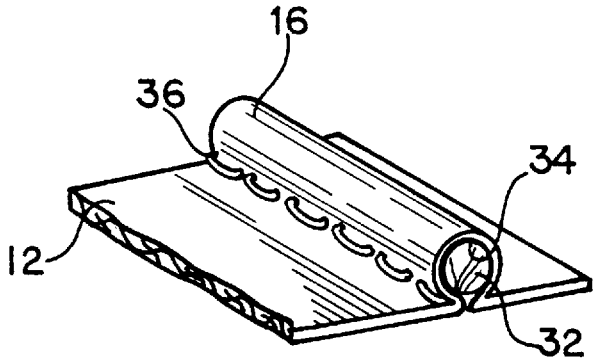
PRIOR ART FIG. 2
FIG. 2 is a perspective view of the dowel utilized in the prior art shown in FIG. 1.
Figure 3:
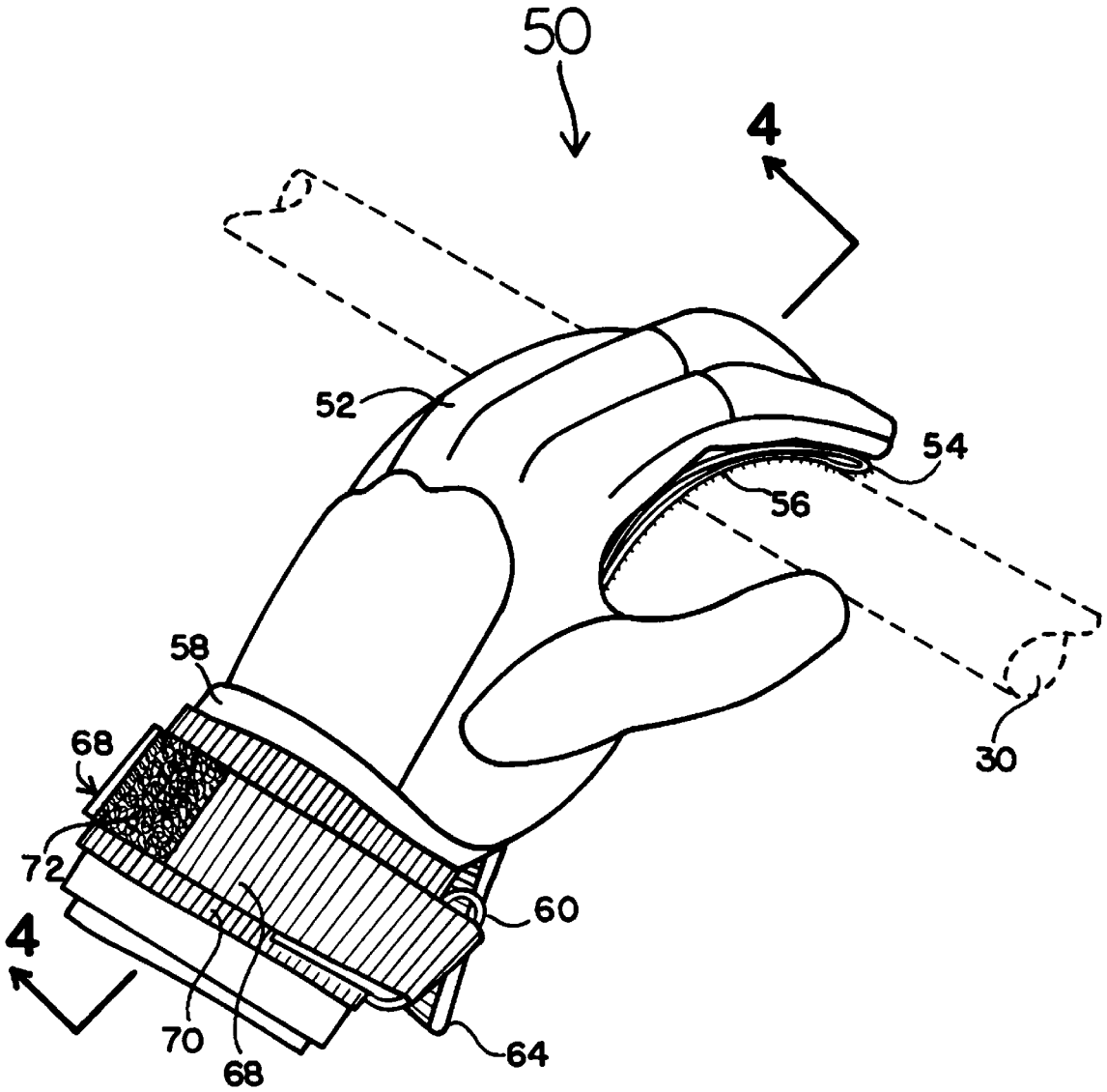
FIG. 3 is a perspective view of the present invention utilized in conjunction with a glove, such as a water skier's glove.

Referring now to FIG. 1 and FIG. 2, a prior art device such as disclosed in the U.S. Pat. No. 4,400,831, to Rietz, is shown. Referring in particular to FIG. 1, it can be seen that a water skier in arcing his fingers over and against the handle 30, in normal gripping relation, places the rib 32 of the gripping device 10 in an over-center position relative to side of bar 30. As long as the user maintains his fingers in this arced manner, the rib 32 remains in the over-centered position, since rib 32 is physically connected to the palm side strapping 12. Wrist strapping 18 is affixed to the wrist end of strapping 12 and is firmly secured to the user's wrist whereby the structural purchase is established by rib 32 in association with the towbar 30.

Thus, the basic pulling force applied to handle 30 represented by arrows 24 are transmitted to the rib 32 and the pulling force is transmitted through rib 32 to strapping 12 as represented by arrows 26, which transmits such pulling force to the wrist strapping 18 at its end 14 as represented by arrows 28.

Referring now to FIG. 2 of the prior art, the rib 32 is shown formed with a dowel 32 having the strapping 12 wrapped and sewn around it to form rib 16 which when centered transfers the force in the direction of the user's fingers at the joint of the user's index finger.

In use, while it is true the rib 16 offers the user a better purchase on handle 30, it is also true that rib 16 has a tendency to slide, hence, the prior art overcomes this by providing a handle 30 having a grove formed therein (not shown) for receiving rib 16 in a non-slip socketed configuration. Unfortunately, rib 16 requires sufficient force in its own right to maintain the friction required to prevent slipping from side to side or during disengagement. Further, when used with the groove, precise release control by the user is inadequate. Accordingly, applicant's present invention overcomes the above described deficiencies.

Referring now to FIGS. 3, 4, 5, and 8, the present invention, shown generally at 50, in this embodiment is affixed to a glove 52 such as worn by water skiers. Affixed to glove 52 is an elongated flat rolling strap loop 54 with a friction or gripping section 56 extending downward to the wrist of the user at extension 64. The strap is attached to the user with the use of an apparatus, and referring particularly to FIG. 8, incorporating a neoprene sleeve 58 having attached thereto a main support strap 70. Strap 70 is affixed at one middle point 71 to sleeve 58 with a pair of identical straps 68, each strap 68 attached at one end 73 to opposing ends of main support strap 70, with the free ends of straps 68 looped through D-ring 60, with the ends then folded back on themselves and attached to a strip 72 affixed along the middle of main support strap 70 and utilizing any suitable means such as, by way of example only and not by way of limitation, Velcro® such that either a loop or hook surface is affixed along and centered on the back of the strapping 70 with the free ends of strap 68 incorporating the remaining part of the fastening system and positioned to make contact with the other fastening surface. In use, the glove 52 and neoprene sleeve 58 is slipped over the user's hand with the sleeve 58 positioned on the user's wrist at the base of the user's hand. The ends of strap 68 are slipped through a D-ring 60, folded back on themselves and attached with the Velcro® fastener 72.

Figure 4:
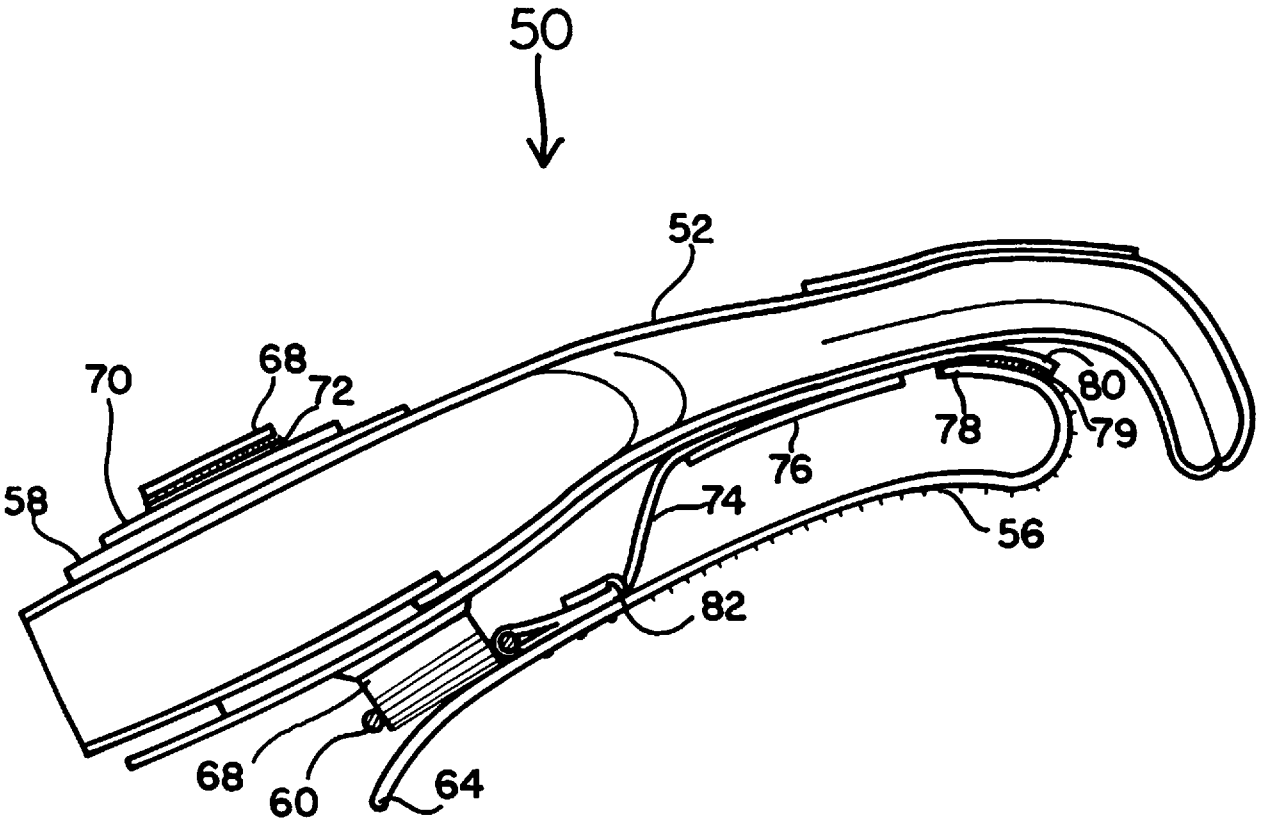
FIG. 4 is a cross-sectional view taken along A—A of the glove shown in FIG. 3.
Figure 5:
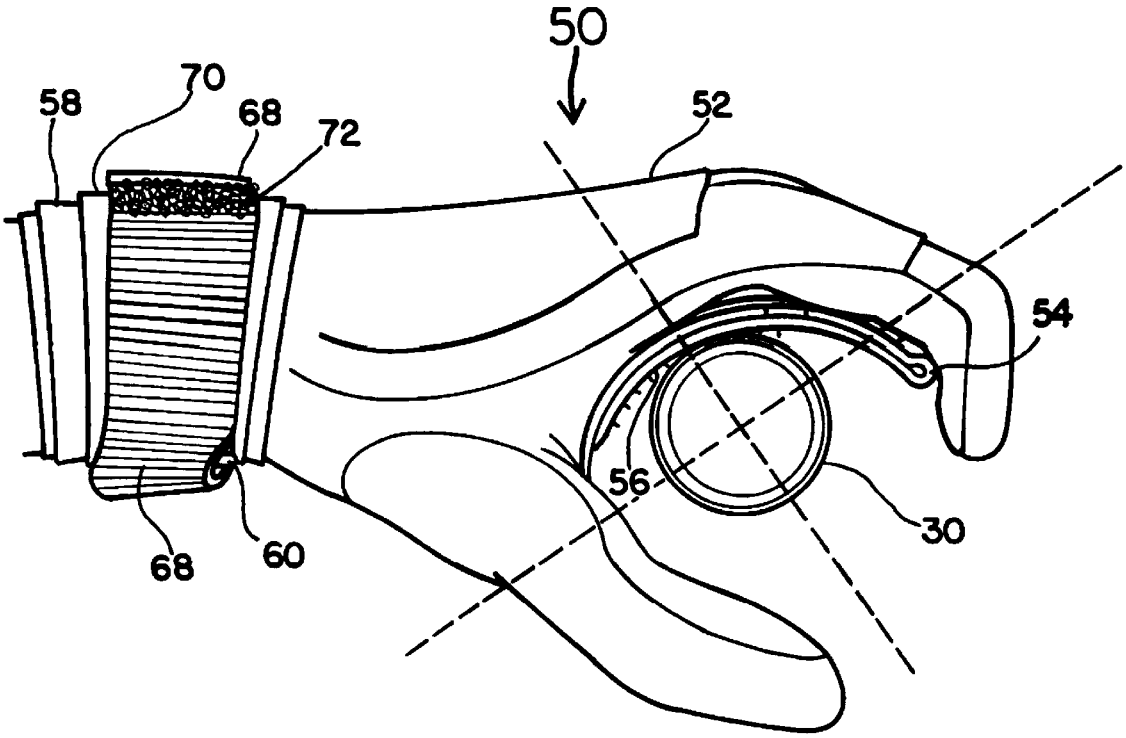
FIG. 5 is a view of the glove device of FIG. 3 being utilized by gripping a round object.

Referring now to FIG. 4, the embodiment of the invention 50 is shown in cross section. As shown glove 52 is affixed to rolling strap loop 54, as shown in FIG. 5, which is connected to gripping section 56 which extends downward to end 64. The D-ring 60 is mounted on the end of gripping surface 56 and attached at 82. Wrist strap 70 is positioned snugly around the user's wrist by passing straps 68 through the "D" ring 60, pulling them tight and fastening the ends 68 to surface 72 using the Velcro. At D-ring 60, an attachment ring strapping 82 a nylon elastic tension strap 74 is attached between D-ring attachment strapping 82 and an anti-pinch pad 76.

In an alternate embodiment as shown in FIG. 5, the elongated flat rolling strap loop 54 is attached to gripping section 56 by an overlap 80 formed on strap loop 54 and an overlap 78 formed at the end of gripping section 56 and joined together by a Velcro fastener 79. However, the preferred embodiment is for flat rolling strap loop to extend continuously in a single strip rather than as a two section strip.

Referring again to FIG. 5 it can be seen that when using the present device, reaching over handle 30 and bringing the gripping surface 56 in contact therewith, rolling strap loop 54 flattens, creating a friction between gripping surface 56 and handle 30.

Figure 8:
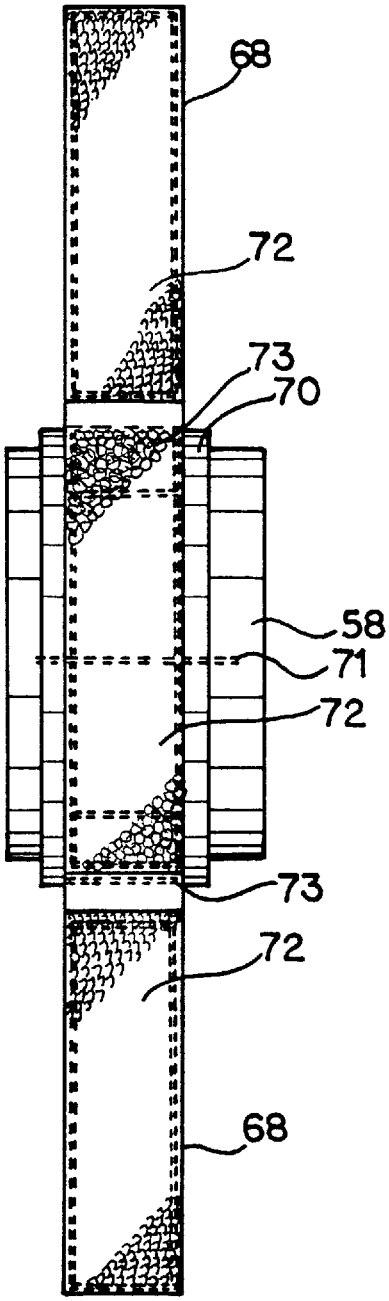
FIG. 8 is a top view of the wrist cinching strap system of the present invention.

Referring now to FIG. 6 and again to FIG. 8, an alternate embodiment of the present invention in which the invention is not affixed to a glove or other device or hand covering but rather in a stand-alone configuration shown generally at 50'. Again, device 50' includes a rolling strap loop 54 having a gripping section 56 formed thereon and extending downward 64 past D-ring strapping 82 attached thereto. D-ring strapping 82 forms a loop for holding D-ring 60. The end of rolling strap loop 64 extends down and covers D-ring 60 to provide protection therefore. The opposing end of rolling strap loop 54 is folded back on itself and attached at 78 and 80 of top strap 77 using a Velcro 79. The opposing end of top strap 77 is affixed to neoprene sleeve 58 with wrist strapping 70 affixed to neoprene sleeve 58 as previously described in the preceding embodiments and on the opposing side from the attachment of sleeve 58 to top strap 77. On the under side of top strap 77 an anti-pinch strap 76 is affixed in a location to position it over the joints of the fingers of a user to reduce top strap 77 from bunching up against and pinching the user's fingers and forming calluses thereon.

A finger loop is formed on the top of the top strap 77 in a location generally in the vicinity where the middle joints of the fingers of a user would be positioned during use of the device. Finger loop 84 is formed having a loop 86 which provides an opening for a finger to be inserted during use or, alternatively, is adapted to be used as a 'T' or flanged anchor brace for positioning between adjacent fingers of the hand of the user. Loop 84 is closed at the bottom at the point of attachment and extending it upward there from to form the 'T' which includes a reinforced, flat top section(reinforcing not shown)

Figure 6:
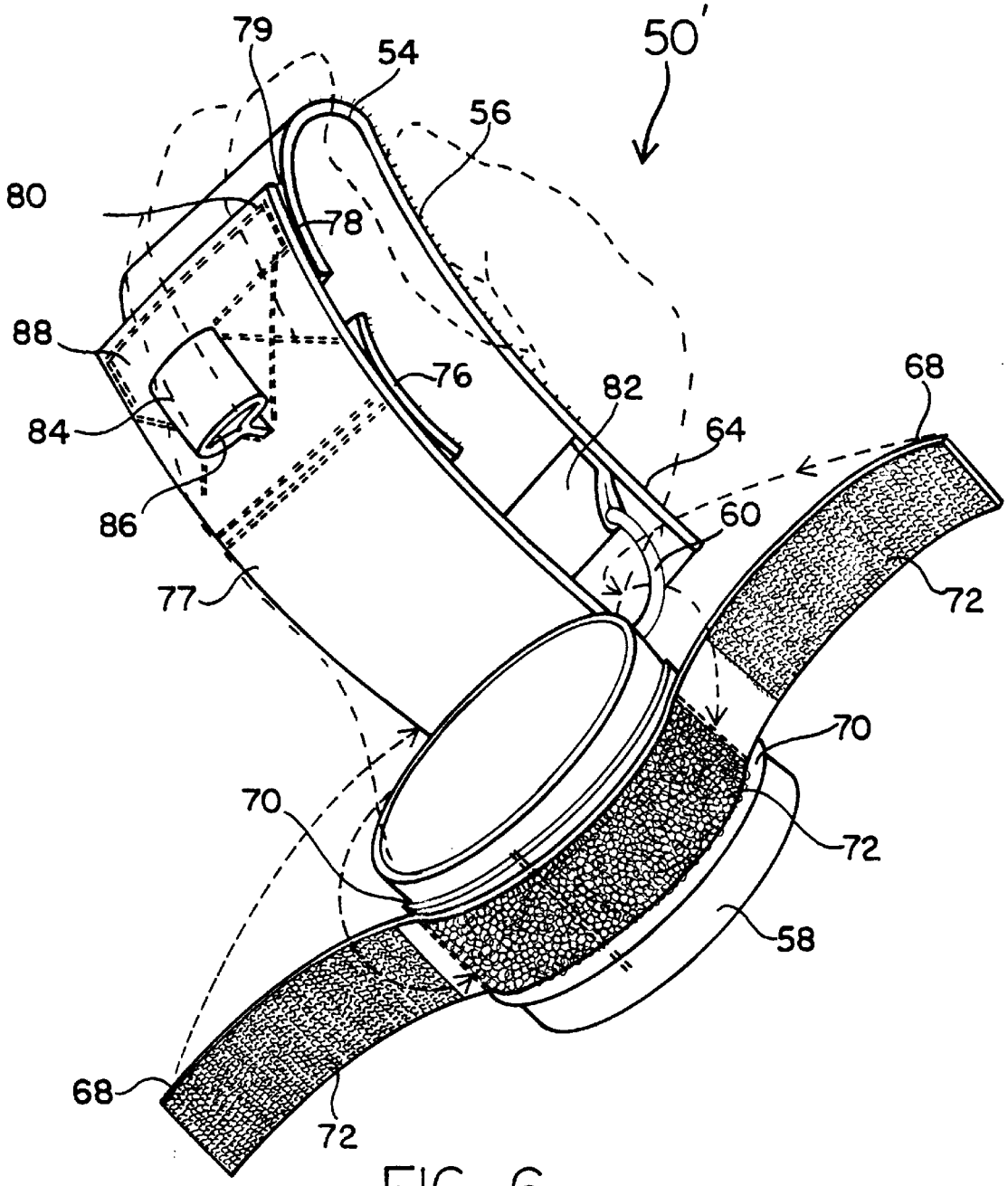
FIG. 6 is a stand alone embodiment of the invention showing use without a glove.
Figure 7:
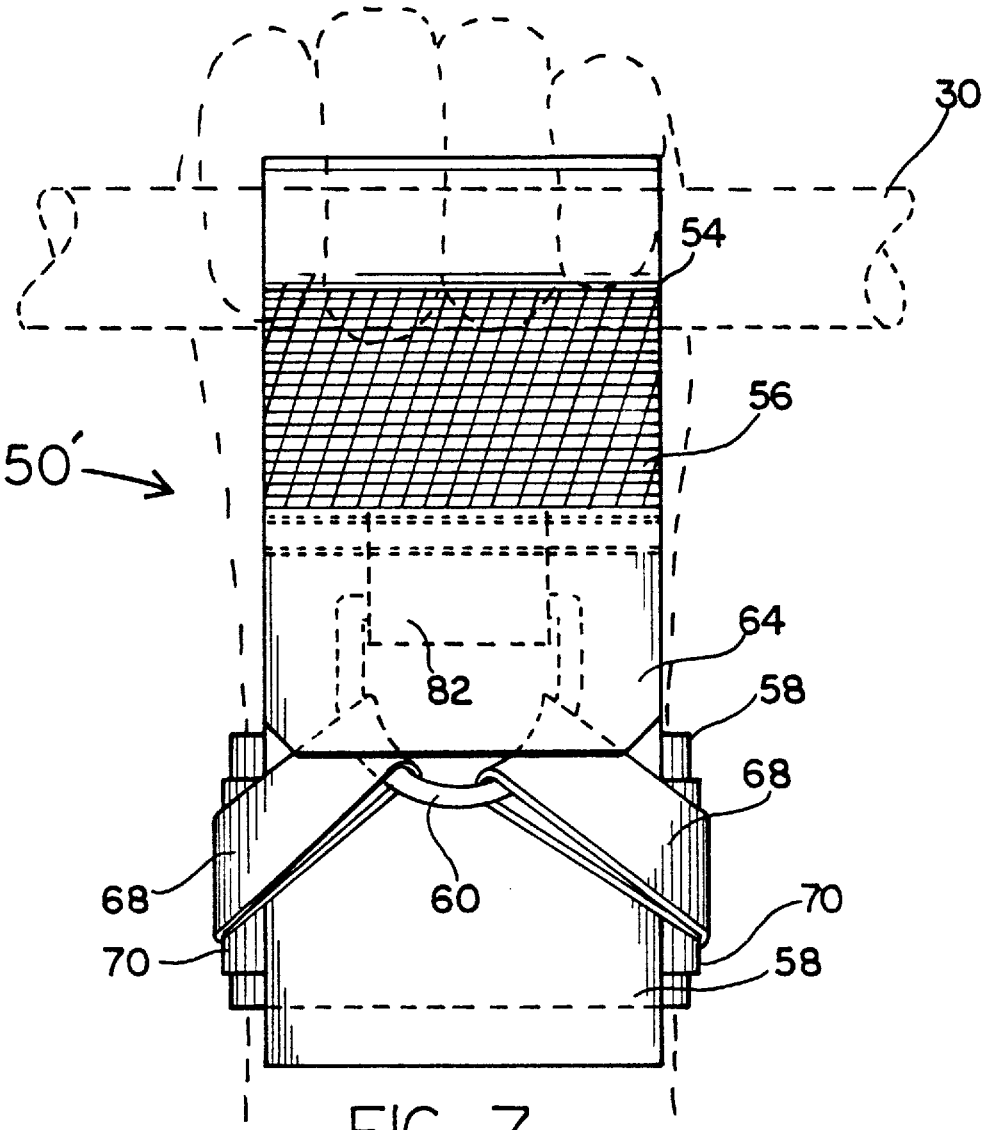
FIG. 7 is a front view of the invention shown in FIG. 6 as it is intended to be used.

Referring now to FIG. 7 and also to FIG. 8, the device of FIG. 6 is depicted in front-view. As shown, the ends of wrist strap 68 are positioned through D-ring 60 and are affixed to the ends of main support strap 70 which is attached at one point to and wraps around neoprene sleeve 58 whereby wrist strapping 70 functions to hold device 50' securely to the wrist of the user. End 64 of rolling strap loop of 54 extends downward covering and protecting straps 68 from premature wear due to the high stress in this area.

Particular attention is now called to the surface of gripping section 56 which has a surface that can be adapted to the material being gripped. By way of example, but not by way of limitation, some examples of the friction surface are ultra suede, prepared leathers, rubberized cloths, silicon impregnated material, kevlars, emery cloth and the like. These materials may be attached as a gripping pad 56 attached to strap 54 or as a gripping section 56 formed on strap 54. The friction produced between the gripping section 56 and the gripped material result in a superior grip on most round surfaces which can be encircled by a user's hand regardless of the material. However, the preferred embodiment for the majority of uses is to utilize nylon webbing or polypropylene webbing and scoring the surfaces of the same with a hot scoring knife, the scoring raising a ridge. Repeated scoring will result in a sawtooth effect as shown at 56 in FIG. 7. As different scoring patterns will result in different gripping efficiency, a particularly useful pattern is to score the webbing transverse to the longitudinal axis of the user's hand and then scoring the webbing at a diagonal to the transverse scoring and the longitudinal axis of the user's hand. This results in a diamond shaped raised surface which is extremely effective in gripping smooth round towbars.

As the operation of the device is basically the same irrespective of whether the stand-alone configuration of the device 50' or the gloved configuration of the device 50 is utilized, the operation thereof will be described with respect to FIGS. 6 and 7.

Referring now to FIGS. 6 and 7 and in particular to the wrist support system of FIG. 8, neoprene sleeve 58 is positioned at the wrist area at the base of the user's hand with top strap 77 positioned against the user's palm. This brings finger loop 84 within position of the user's fingers to be either gripped in the 'T' configuration or by slipping a finger through opening 86 formed by finger loop 84. Tightening straps 68, each attached at one end 73 to the ends of main wrist support strap 70, are threaded as indicated by the arrows in FIG. 6 through D-ring 60 and back around neoprene sleeve 58 to cinch the main support strap 70 into position using the Velcro fastener portions 72.

Further, an anti-pinch strapping 76 is formed on the underside of top strap 77, that is the side opposite the side to which neoprene sleeve 58 and finger loop 84 are attached. This strapping is provided to prevent top strap 77 from bunching up into the finger creases where the fingers join the palm, which eliminates pinching of the hand. The Velcro fastener 79 which joins rolling strap loop 54 with the end of top strap 77 may be provided as a safety release upon the occasion the rolling loop should become snagged upon an open handle or the like.

In use, the rolling strap loop 54 is free floating so that as a user grips a circular object the friction or gripping section 56 conforms to the shape of the gripped object and clings to it because of the pressure applied by the fingertips of the user. Top strap 77 slides over the rolling strap loop 54 and the back of the user's hand at the wrist comes in contact with the wrist strapping cinching mechanism 70 locking the grip into a relationship that transfers the force through the hand and to the upper arm and shoulder area. By grasping the object with a slight overreach, the system positions itself so as to best utilize the main wrist strap system 70, transmitting the pulling force of object 30 to the skeletal frame of the user's upper arm and shoulders.

Accordingly, only slight effort is required in maintaining the fingers in a curved position over object 30. This keeps the friction gripping section 56 in stationary contact with the object 30. Further, straightening the wrist of the user aligns the forearm in a neutral pulling position, whereby the gripping section 56 only requires a minimum amount of gripping force to maintain a firm grip on the handle. When desired, release is affected by merely opening the fingers or straightening them. The release is smooth and has no disturbing jerking or catching during the release. Flexibility in positioning object 30 in the palm of the hand or out along the finger area is accomplished by merely releasing pressure which allows the bar to change its position in relation to the user's hand, unlike prior art devices wherein release of pressure means release of the user's grip as the user has no ability to regain the grip during actual use because of the pulling forces involved.

The forms of the invention herein disclosed are the preferred embodiments, many others are possible. It is not intended to mention all of the equivalent forms or ramifications of this invention. It is understood that the terms and use herein are merely descriptive rather than limiting and that various changes may be made without departing from the spirit or scope of the invention.

I claim:

1. A wrist strap for a grip pad for assisting a user's grip on a bar, comprising:

a wrist strap for encircling the wrist of the user, a ring adapted to be attached at a point of attachment to a grip pad, the grip pad for being received near the palm of the user's hand;

a pair of straps, each of said straps having an attached end and a free end, said attached end being attached to the wrist strap near the back of the wrist of the user's hand, proximally to the point of attachment of said ring on said grip pad, and one of said straps being attached near each side of the wrist; and each of said straps having securing means near the free end, so that one of said straps may be passed over a side of the wrist, passed through the ring and secured to the wrist strap.

2. The wrist strap of claim 1 wherein the ring is a D-ring.

3. The wrist strap of claim 1 wherein the point of attachment of the ring is near the palm of a glove.

4. The wrist strap of claim 1 wherein the pair of straps are connected to form a band.

5. The wrist strap of claim 1 wherein the securing means are hook and loop type fasteners.

6. The wrist strap of claim 1 wherein the securing means are adjustable.

* * * * *